US005515982A

United States Patent [19]

Hasegawa et al.

[11] Patent Number: 5,515,982

[45] Date of Patent: May 14, 1996

[54] TELESCOPING SHUTTLE FOR A CARGO CONTAINER HANDLING CRANE

[75] Inventors: Shuji Hasegawa; Matsamitsu Enoki, both of San Mateo, Calif.

[73] Assignee: Paceco Corp.

[21] Appl. No.: 225,842

[22] Filed: Apr. 11, 1994

[51] Int. Cl.[6] ..... B66C 19/00

[52] U.S. Cl. ..... 212/316; 212/325; 212/326; 414/140.3

[58] Field of Search ..... 414/140.3, 140.4; 212/161, 218, 219, 220, 316, 319, 324, 325, 326

[56] References Cited

U.S. PATENT DOCUMENTS

| | | | |
|---|---|---|---|
| 3,784,028 | 1/1974 | Stewart | 212/220 |
| 3,812,987 | 5/1974 | Watatani | 212/219 |
| 5,048,703 | 9/1991 | Tax et al. | 212/161 |

*Primary Examiner*—William E. Terrell
*Assistant Examiner*—Thomas J. Brahan
*Attorney, Agent, or Firm*—Bruce & McCoy

[57] ABSTRACT

A method and apparatus for vertically telescoping an automatic shuttle used for cargo container transfer in a cargo container handling gantry crane for reducing container handling cycle times.

8 Claims, 4 Drawing Sheets

TELESCOPING SHUTTLE FOR A CARGO CONTAINER HANDLING CRANE

CROSS-REFERENCE TO RELATED APPLICATION

The present invention is related to U.S. patent application Ser. No. 08/177,113 for Cargo Container Transfer Systems for Cranes filed Dec. 31, 1993, by Shuji Hasegawa and Masamitsu Enoki and assigned to Paceco Corp., which is incorporated herein by reference.

BACKGROUND OF THE INVENTION

1. Field of the Invention

The present invention relates to improved apparatus and novel methods of operation for cargo container handling cranes having a horizontal gantry supported at an elevated location above the cargo container pickup and deposition areas. More particularly, the present invention relates to the apparatus and method for reducing cargo container handling and transfer cycle times by employing a shuttle suspended from the gantry of a cargo container handling crane which transports containers horizontally along the gantry.

The shuttle is computer controlled and has a floor or platform which can be lifted and lowered by a telescoping framework while concurrently transporting containers along the gantry. The raising or lowering of the shuttle floor is effected during horizontal movement of a container to reduce the lifting and lowering cycle times for a complete transfer cycle by delivering the container at the optimum height to the lifting spreaders disposed at the opposite ends of the gantry.

2. Description of the Prior Art

The handling and protection of cargo or material during its transportation has been greatly facilitated by the advent of containerization many years ago. Rail mounted dockside gantry cranes having retractable booms have now been long accepted as the standard in the industry for loading and unloading containerized cargo and fungible bulk materials. The containers are moved by the cranes between waterborne vessels and dockside transportation equipment.

When a cargo container transport ship is berthed alongside a dock, a gantry crane is moved along the dock parallel to the ship to a position where a retractable boom can be extended across the beam of the ship above the ship's cells which are the cargo container carrying area. The retractable boom in its operating position extends horizontally outboard from the crane's superstructure and, in its retracted position, clears the superstructure of any ship berthed alongside the dock adjacent to the crane. Containers can be transported along the gantry of the crane between the dockside pickup and deposition area and any storage position located within the beam of a berthed ship in its holds or on its deck.

In the particular form of a gantry crane to which the present invention pertains, the purpose is to move cargo containers a specific horizontal distance from a pickup area to a deposition area. In each operation, in the most usual situation, the pickup area is either a dockside location where a container is picked off of a flatbed trailer or transport truck or railroad car, and moved outboard by the crane and lowered into a shipboard cargo container cell, or the reverse, wherein a container is lifted from a cell onboard ship and moved to a dockside storage area or a truck, trailer, or railroad car.

The gantry portion of the cargo container handling crane of the preferred embodiment of the present invention includes the retractable boom and a dockside portion and a rear extension of said boom supported by the crane superstructure. However, it is applicable to any crane wherein containers are moved along a gantry from a pickup position to a deposition area. Trolleys run along the gantry and suspend cargo container lifting spreaders from fleet-through wire rope reeving for attaching to and picking up cargo containers.

In a transfer cycle by a crane, the container must first be picked up, then lifted vertically, moved horizontally, and then lowered to its deposition area. During a portion of the move, vertical and horizontal movement of the container can occur simultaneously. However, for each transfer cycle, the crane must raise or lower a container a specific distance to clear the side of a ship, and a round trip transfer cycle takes a substantial period of time to handle one container.

In addition to the portion of the transfer cycle time required to pickup, lift, move, lower, and deposit the container, there is also a delay at each end of the cycle because of sway or pendulum movement which is induced into the load by virtue of the starting and stopping of the horizontal movement of the container lifting apparatus along the gantry. It takes additional time to abate the sway and to position the container by selectively controlling the forward and reverse movement of the trolley.

A more recent development in the field of cargo container handling is the development of the hatch coverless container ships which unfortunately has increased the container transfer cycle time in the prior art gantry cranes. These ships were developed to reduce lashing work or container tie down time for containers stacked on the open deck of the ship. This development provides cell guides which project upwards from the deck of the ship and which therefore require every vertical movement of a container to clear not only the side of the ship but the tops of all the upward projecting cell guides as well which previously did not extend above the ship's deck.

Therefore, in comparison, when loading and unloading the old type of ship, the container did not always have to be fully lifted a specified height above the deck of the ship. It was only necessary to clear the deck of the ship until containers began to be stacked on top of the deck. At that point, it was still necessary only to lift containers over those already stacked on the deck although when a ship is properly loaded and unloaded, it is accomplished in a way in which the outboard containers are placed on the ship first and unloaded last so that subsequent containers do not have to be lifted over more than the minimum height of on-deck containers than is necessary. As a result, the container handling productivity for hatch coverless ships is considerably lower in comparison with conventional container ships because the handling pass or transfer cycle on the latter is substantially shorter until stacked containers on the ship gradually increase the cycle time.

One method of improving the speed of operation of a crane is to provide a twin lift crane in which two containers are handled at the same time by the crane. However, this requires nearly a complete duplication of machinery: at least twin booms and two-thirds the superstructure of two cranes, but the crane can handle two containers simultaneously by the same number of operators.

A further improvement in the art is disclosed by the related invention for a Cargo Container Transfer System for Cranes whereby cargo containers can be simultaneously lifted and lowered independently at opposite ends of the gantry crane while concurrently containers are transported along the gantry by a computer-controlled automatic shuttle. A pair of trolleys disposed on the gantry of the crane at opposite ends thereof are dedicated to lifting and lowering the containers independently and do not horizontally traverse with them. The automatic shuttle traverses the gantry between the two lifting and lowering trolleys and horizontally transports containers between the trolleys. This allows three containers to be handled almost simultaneously, one being lifted, one being transported horizontally, and one being lowered.

In a typical cargo container handling gantry crane of the prior art, the container lifting apparatus needs to be raised during each container transfer cycle only high enough to clear all obstacles such as the side of a ship or the containers lashed on deck. In the improved method of the related invention, however, the container lifting apparatus of the trolleys at each end of the gantry must be raised almost to the gantry during every container transfer cycle to either deposit containers onto the shuttle or to pick them off. The present invention is an improvement on the shuttle disclosed by the related invention which further lowers the transfer cycle time by raising and lowering the platform or floor of the shuttle which transports the cargo containers. The height that a lifting spreader must be raised for the purpose of depositing a container in the automatic shuttle is therefore reduced by providing a telescoping framework which lifts and lowers the floor of the shuttle to the lowest possible or optimum height as dictated by the transport vessels on-deck configuration. The height of the container lifting apparatus must be raised at each end of the gantry and thereby further reduces the container transfer cycle times.

SUMMARY OF THE INVENTION

The present invention is a vertically telescoping shuttle for a cargo container handling crane having a horizontal gantry supported at an elevated location above container pickup and deposition areas. The crane has independent lifting and lowering apparatus for cargo containers disposed at opposite ends of the gantry and formed for movement therealong. Each of the apparatus has a cargo container lifting spreader suspended therefrom for lifting and lowering cargo containers from and to the respective pickup and deposition areas. A shuttle, comprised of a framework suspended from the gantry, is formed for movement along the gantry between the two lifting spreader apparatus. The framework of the shuttle has a floor and is formed for receiving cargo containers from the lifting spreaders and transporting the containers on the floor from either of the spreaders to the other irrespective of their positioning along the gantry. The shuttle has an elevator means for raising and lowering the floor of the shuttle. A means is provided for stabilizing the floor in its lowered position relative to the framework.

The present invention also includes the method of operation of a cargo container handling crane having a horizontal gantry, supported at an elevated location above the container pickup and deposition areas. Cargo containers are lifted and lowered from and to the pickup and deposition areas independently and simultaneously at locations proximate to opposite ends of the gantry, and are transported between those locations concurrently on an automatic shuttle whereby each cargo container is first lifted from a pickup area at one end of the gantry, transported along the gantry by the automated shuttle, and lowered to a deposition area at the other end of the gantry while other containers are concurrently being lifted, lowered and transported. The method comprises performing a portion of the lift and lower cycle by raising and lowering the floor of the shuttle during its horizontal traverse between the lifting and lowering spreaders at the opposite ends of the gantry.

OBJECTS OF THE INVENTION

It is therefore an important object of the present invention to provide a new and novel method and apparatus for reducing the container transfer cycle time of the operation of a cargo container handling crane.

It is another object of the present invention to provide a method and apparatus for reducing to a minimum the lift and lowering heights for transferring containers to and from an automatic shuttle on a cargo container handling crane.

It is a further object of the present invention to provide a telescoping shuttle with a variable level floor for a cargo container handling crane.

It is still another object of the present invention to provide an apparatus to effect partial lifting and lowering of a container during horizontal movement of a container in a container transfer cycle by a shuttle for a cargo container handling gantry crane.

Other objects and advantages of the present invention will become apparent when the apparatus and methods of the present invention are considered in conjunction with the accompanying drawings.

DESCRIPTION OF THE PREFERRED EMBODIMENT

Reference is made to the drawings for a description of the preferred embodiment of the present invention and the prior art wherein like reference numbers represent like elements on corresponding views.

Figure 1:
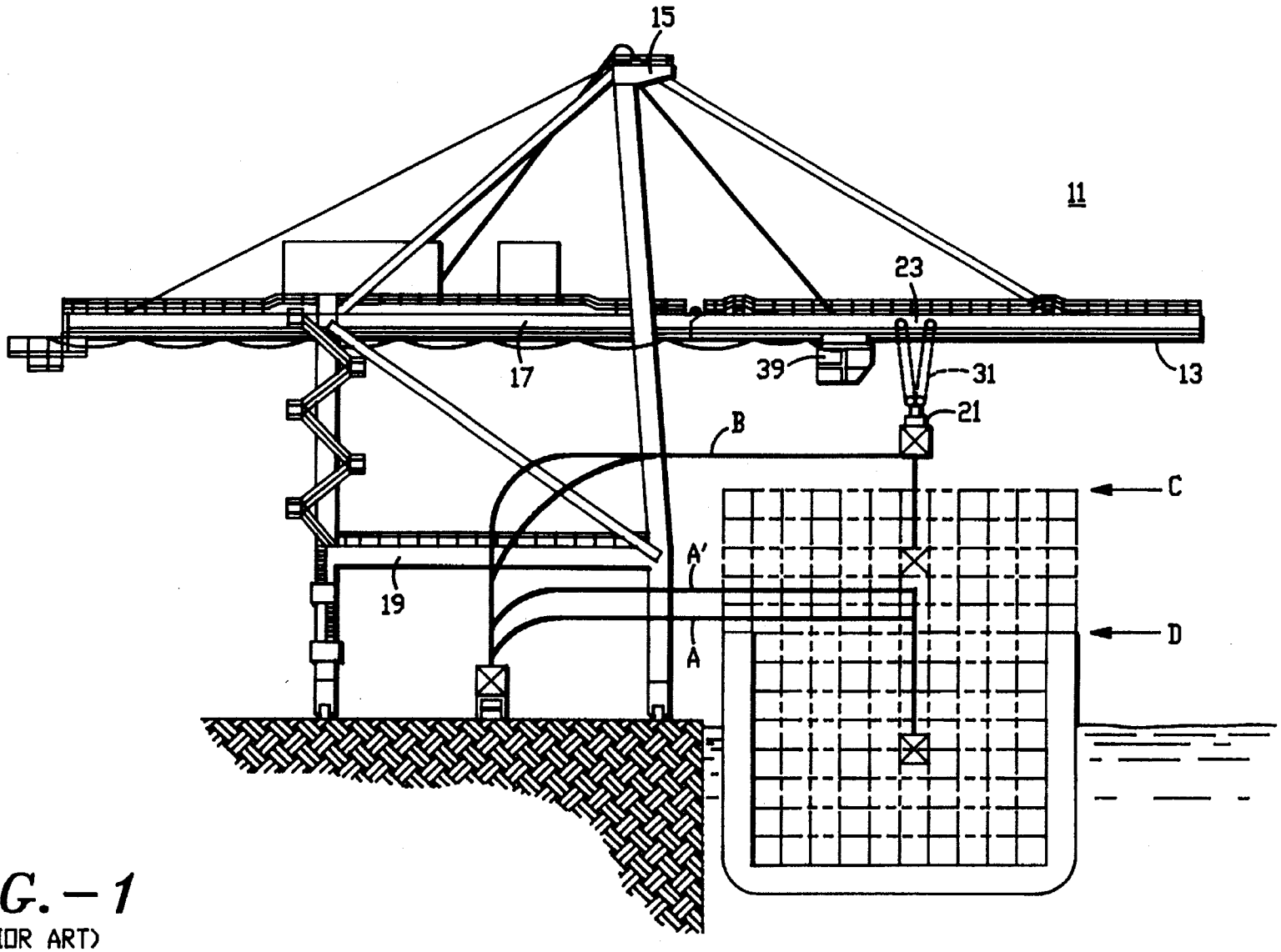
FIG. – 1 (PRIOR ART)
FIG. 1 is a side elevation of a typical cargo container handling gantry crane illustrating the loading of both standard and hatch coverless container ships shown in partial cross-section.

Reference is made to FIG. 1 of the drawings for an illustration of a typical cargo container handling gantry crane 11 with a retractable boom 13 which projects outboard from the superstructure 15 of the crane over the beam of a ship berthed alongside the dock. The boom in the illustrated embodiment folds upward to project just short of vertically whereby the superstructure of a ship can pass alongside the dock and not interfere with the boom when it is raised. In other types of gantry cranes, where height restrictions limit raising the boom, typically in ports located near airports, the gantry can slide horizontally outboard over a ship or partially fold when it is raised.

The horizontal gantry 17 of the crane extends rearward of the retractable boom in a dockside portion which resides within the superstructure 15 of the crane, and projects further rearward out over a storage area on the landside end of the crane. It is supported at an elevation above container pickup and deposition areas. The gantry is designed to project outboard over a ship moored alongside a dock, and the crane superstructure is designed to straddle the dockside cargo container pickup and deposition areas to move containers from and to shoreside transportation. Railroad tracks and roadways pass underneath the superstructure, and the rear projection of the crane, for the delivery and removal of cargo containers thereunder by transportation equipment. The crane superstructure also includes horizontal crossbracing 19 disposed below the gantry.

The hoist, transfer, and lowering cycle paths of a cargo container, between shoreside and ship pickup and deposition locations, are represented by the black solid lines which show the container movement paths. When loading a standard container ship, the containers need be lifted only high enough to clear the side of the ship, and the raise and lowering cycles are greatly reduced as are illustrated by container transfer paths A and A'. This occurs because the container cells are all disposed within the hold of a ship illustrated by the dashed lines. Container path A represents movement of containers into the ship holds. Once the ship has been filled, then containers are stacked on top of the deck of the ship and lashed thereto. The deck level of the ship is designated by D. During this portion of the loading sequence, the containers must be lifted only high enough to clear any on-deck containers represented by container path A' where one level of containers are lashed on deck.

The hatch coverless type of ship is also illustrated by this same illustration by showing the dashed lines of the cells extending to C above the ship's deck. Thus, for the deposition of each container on a hatch coverless ship, it must be raised to clear all of the cell structure above the deck of the ship for each container transfer cycle. While the time needed to lash the containers to the deck is greatly reduced by the hatch coverless ship, the cycle time for container transfer is increased for every container because of the additional specific lifting and lowering distance which must be covered during each cycle to clear the cell structures on top of the deck of the ship.

Figure 2:
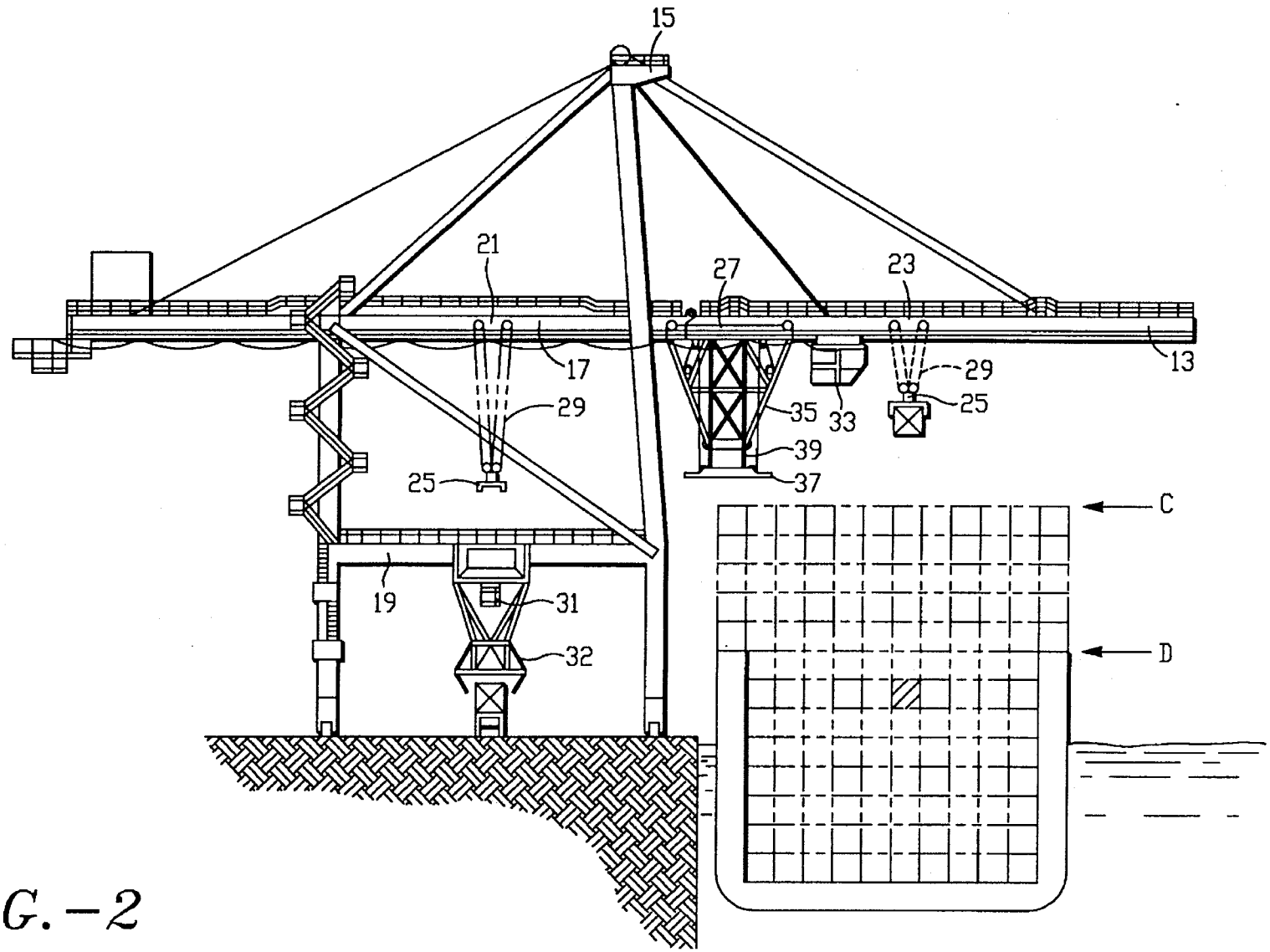
FIG. 2 is a side elevation view of a cargo container handling crane with a telescoping automatic shuttle suspended from the gantry thereof.

The related invention identified earlier herein is disclosed in FIG. 2 of the drawings and comprises an improved version of a cargo container handling gantry crane which employs an automatic shuttle to transport containers along the horizontal gantry between two trolleys having cargo container lifting spreaders suspended therefrom. The telescoping shuttle of the present invention is an improvement on the computer controlled shuttle disclosed therein where each cargo container must be lifted nearly to the gantry to clear the floor of the shuttle.

Figure 4:
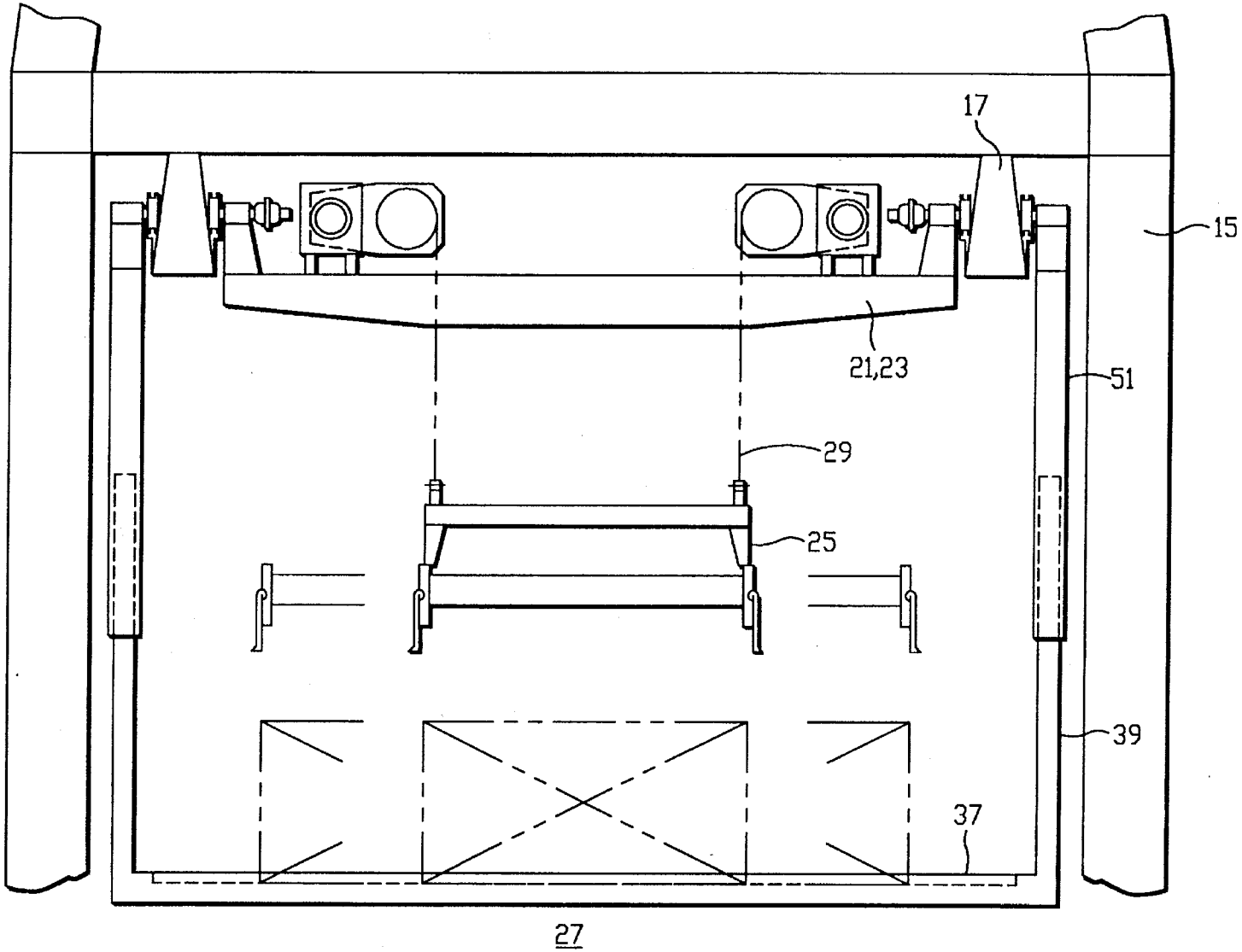
FIG. 4 is a broken-out end elevation view of the telescoping shuttle of FIG. 3 and a trolley.

Reference is made by FIG. 2 of the drawings hereto which shows the configuration of a gantry crane 11 employing the preferred embodiment of the improved telescoping shuttle of the present invention which is designed further reduce cargo container transfer cycle time over the described related invention. As in the related invention, a pair of trolleys 21, 23 are usually disposed at opposite ends of the gantry 17 and have cargo container lifting spreaders 25 suspended therefrom for attaching to a container to lift and lower cargo containers from and to pickup and deposition areas located below the gantry. The movable trolleys and the shuttle 27 are supported on two pairs of collinear different gauge tracks that are secured to the gantry 17. In a preferred embodiment, the trolleys are mounted on the narrower pair of the collinear different gauge tracks while the automatic shuttle is supported on the wider pair of tracks as illustrated in FIG. 4.

Standard computer control of the trolleys 21, 23 utilizes an encoder which counts revolutions of the drive motors or wire rope drums which operate the drive machinery and hoist ropes 29 for the lifting spreader 25. An optical pulse generator is created by passing an optical beam through a perforated disk which is secured to the drive motors or wire rope drums. An optical detector senses the breaks in the optical beam caused by the disk, and they are counted by the computer whereby the exact position of a cargo container, both vertically and horizontally, with respect to the gantry, and the relative movement with respect thereto, can be accurately determined, and thereby the transfer of the containers accurately controlled. This is fundamental technology in cargo container handling by a crane, and once a container has been attached to a container or released, movement of the trolley and the spreader is computer controlled.

However, operator control is required at each end of the cycle for two purposes: attachment of a lifting spreader to a container, and positioning of a container for deposition. The operator must accurately locate the spreader above a container for pickup at the landside end of the crane, from a trailer, truck, or railroad car, or from a stack of containers in a storage area or freestanding on the deck of a ship. The operator must also accurately locate a spreader carrying a container for lowering into a ship's cell or onto a truck, trailer, or railroad car, or onto a stack of containers in a storage area or freestanding on the deck of a ship.

A first operator's cab 31 is disposed proximate to the landside container pickup and deposition areas. It is usually secured to, and can be moved to different locations along, the crossbracing 19. In the related invention, it is secured to the guide chute 32 and moves with it. This permits the operator to be continually located close to the container pickup area where the landside lifting spreader 25 must be attached to a cargo container located on shoreside transportation or in a storage area. A second operator's cab 33 is suspended from the outboard or shipside trolley 23 and travels with it as it moves along the gantry so that the operator is located above the ship's cells that containers must be lowered into or removed from.

The telescoping automatic shuttle 27 suspended from the gantry 17 is formed for movement along the gantry 17 between the trolleys 21, 23 and for receiving cargo containers from the lifting spreaders 25. The shuttle automatically transports the containers from either trolley and spreader combination to the other. The shuttle is designed to allow the trolleys, and a cargo container secured to a lifting spreader 25 to pass through the shuttle. This capability permits either trolley to deposit a container in the shuttle after it has been lifted above the shuttle floor and the shuttle moved under the trolley.

The movement of the shuttle 27 is computer controlled in the same way as the trolleys 21, 23 to permit movement of a cargo container disposed thereon from one trolley to the other irrespective of the location of the trolleys on the gantry 17, and, after the container has been removed therefrom, to return the shuttle to the other trolley. The computer also controls the lifting and lowering of the loads by the movable trolleys onto and off of the shuttle once they have been picked up. An automatic release and pickup onto and off of the shuttle is also computer controlled and utilizes the same sensing system presently in use for determining whether the twistlocks on the lifting spreaders 25 are engaged to or disengaged from a cargo container. The operators control the placement and attachment of the lifting spreader onto a cargo container to be lifted or the lowering of a container or an empty spreader into a ship's cell guide, or placement onto shoreside transportation, at the lower end of the lowering cycle.

The telescoping shuttle 27 is designed to raise and lower the floor 37 of the shuttle and reduce the distance the trolleys have to lift and lower the containers from the pickup to the deposition areas. The raising and lowering of the floor of the shuttle is also computer-controlled for automatic operation. The purpose is to lower the shuttle to the lowest limit possible for receiving or delivering a container from or to a trolley either dockside over a pickup or deposition area or shipside over a ship depending upon the height of the cells or containers stacked on the ship's deck. The cycling of the telescoping shuttle up and down is concurrent with its horizontal movement to maximize the reduction in container transfer cycle time.

Figure 3:
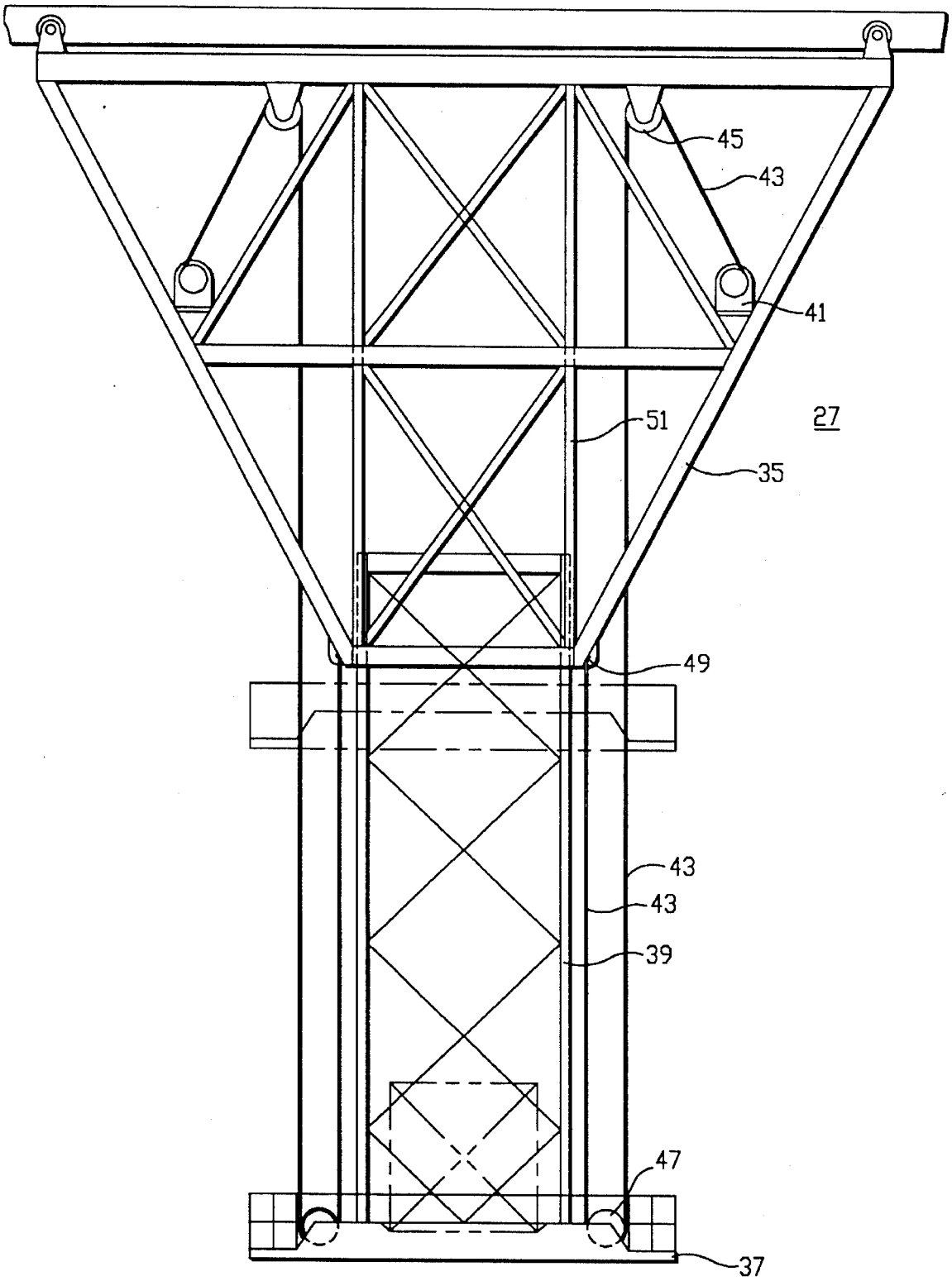
FIG. 3 is a broken-out side elevation view of the telescoping shuttle of the cargo container handling crane of the present invention.

Reference is made to FIGS. 3 and 4 of the drawings which show the configuration of the preferred embodiment of the telescoping shuttle 27 of the present invention. The basic framework 35 of the telescoping shuttle is very similar to that disclosed by the related invention, but the suspended framework includes a sub frame 39 secured thereto and intermeshed therewith in telescoping relation. The floor 37 in the subframe is formed for receiving the cargo container from the lifting spreaders 25 suspended from the moveable trolleys 21, 23 and transporting the containers on said floor from either of the trolleys to the other irrespective of their positioning along the gantry as in the related invention.

An elevator means is provided for raising and lowering the floor 37 of the shuttle 27 relative to the suspended shuttle framework 35. The means interconnects the framework and the sub frame 39 whereby the sub frame reciprocates vertically with respect to said framework. The elevator means can be of various designs such as winch-driven wire rope reeving which interconnects the frames or motor-driven intermeshed rack and pinion gear systems. The former is illustrated in the drawings with a winch 41 located on the suspended framework 35 which operates a wire rope 43 that runs to a reversing sheave 45 at the top of the framework and down around another reversing sleeve 47 at the bottom of the subframe and back to a dead end 49 at the bottom of the framework.

A means is provided for stabilizing the floor 37 of the subframe 39 in its lowered position relative to the suspended framework 35 of the shuttle. It includes a vertical guide means mounted on the framework and at least a pair of vertically extending rigid members secured to the subframe perpendicular to the subframe floor and engaged with the vertical guide means whereby reciprocation of the rigid members in the guide means raises and lowers the floor in a predefined vertical track relative to the suspended framework and maintains the floor in the track. In a preferred embodiment of the invention, the vertical guide means which is mounted on the framework includes tubular guide members 51 and the vertically extending rigid members 39 secured to the subframe reciprocate telescopically within the tubular guide members of the framework.

The present invention also includes the method of operation of any cargo container handling crane having a horizontal gantry supported at an elevated location above the container deposition and pickup areas and wherein cargo containers are lifted and lowered independently and simultaneously at locations proximate to opposite ends of the gantry and are transported between those locations on an automatic shuttle. Each container is first lifted and lowered from a pickup area at one end of the gantry, transported along the gantry by an automated shuttle at a height only high enough to clear all obstructions, and then lowered to a deposition area at the other end of the gantry while other containers are concurrently being lifted, lowered and/or transported. The improved method includes performing a portion of the lift and lower cycle of the containers by raising and lowering the floor of the shuttle by a vertically telescoping subframe during its horizontal traverse between the spreaders at the opposite ends of the gantry whereby the cycle time of the lifting and lowering of containers being effected at opposite ends of the gantry can be reduced.

Thus, it will be apparent from the foregoing description of the invention in its preferred form that it will fulfill all the objects and advantages attributable thereto. While the apparatus and method of the present invention have been illustrated and described in considerable detail, the invention is not to be limited to such details as have been set forth except as may be necessitated by the appended claims.

We claim:

1. A vertically telescoping shuttle for a cargo container handling crane having a horizontal gantry supported at an elevated location above container pickup and deposition areas, said crane having independent lifting and lowering apparatus for cargo containers disposed at opposite ends of said gantry and formed for movement therealong, each of said apparatus having a cargo container lifting spreader suspended therefrom for lifting and lowering cargo containers from and to said pickup and deposition areas, said shuttle comprising a framework suspended from said gantry and formed for movement along said gantry between the two lifting spreader apparatus, said framework having a floor formed for receiving cargo containers from said lifting spreaders in midair and transporting said containers on said floor from either of said spreaders to the other irrespective of their positioning along said gantry, a means for raising and lowering said floor of said shuttle relative to said framework, and means for stabilizing said floor in its lowered position relative to said framework.

2. The telescoping shuttle of claim 1 wherein the means for raising and lowering said floor includes a subframe secured to said floor and which intermeshes with said suspended framework in telescoping relation and is raised or lowered by an elevator means interconnecting said framework and said subframe.

3. The telescoping shuttle of claim 2 wherein said elevator means includes winch-driven wire rope reeving interconnecting said frames for raising and lowering said subframe.

4. The telescoping shuttle of claim 2 wherein said means for stabilizing said floor in its lowered position relative to said suspended framework includes vertical guide means mounted on said framework and at least a pair of vertically extending rigid members secured to said subframe perpendicular to said floor and engaged with said vertical guide means whereby reciprocation of said rigid members in said guide means raises and lowers said floor in a predefined track relative to said suspended framework and maintains said floor in said track.

5. The telescoping shuttle of claim 4 wherein said vertical guide means mounted on said framework includes tubular guide members, and said vertically extending rigid members secured to said subframe reciprocate telescopically within said tubular guide members.

6. A vertically telescoping shuttle for a cargo container handling crane having a horizontal gantry supported at an elevated location above container pickup and deposition areas, said crane having independent lifting and lowering apparatus for cargo containers disposed at opposite ends of said gantry and formed for movement therealong, each of said apparatus having a cargo container lifting spreader suspended therefrom for lifting and lowering cargo containers from and to said pickup and deposition areas, said shuttle comprising a framework suspended from said gantry and formed for movement along said gantry between the two lifting spreader apparatus, said framework including vertically-disposed tubular guide members, a floor in said subframe and formed for receiving cargo containers from said lifting spreaders and transporting said containers on said floor from either of said spreaders to the other irrespective of their positioning along said gantry, and an elevator means for raising and lowering said subframe with respect to said framework.

7. The method of operation of a cargo container handling crane having a horizontal gantry, supported at an elevated location above the container pickup and deposition areas, on which cargo containers are lifted and lowered from and to said pickup and deposition areas independently and simultaneously at locations proximate to opposite ends of said gantry, and said cargo containers are transported between said locations concurrently on an automatic shuttle whereby each cargo container is first lifted from a pickup area at one end of said gantry, transported along said gantry by said automated shuttle, and lowered to a deposition area at the other end of said gantry while other containers are concurrently being lifted, lowered and transported, the method comprising performing a portion of the lift and lower cycle by raising and lowering the floor of the shuttle during its horizontal traverse between the lifting and lowering spreaders at opposite ends of the gantry.

8. The method of claim 7 wherein the floor of said shuttle can be raised and lowered with respect to said gantry by a vertically telescoping subframe whereby the cycle time of the lifting and lowering of containers being effected at opposite ends of the gantry can be reduced.

* * * * *